US008105211B2

(12) United States Patent
Alexander

(10) Patent No.: US 8,105,211 B2
(45) **Date of Patent: *Jan. 31, 2012**

(54) EDGE FITTINGS FOR SOFT-EDGED TRAMPOLINES

(75) Inventor: Keith Vivian Alexander, Christchurch (NZ)

(73) Assignee: Board & Batten Inc. (KY)

( * ) Notice: Subject to any disclaimer, the term of this patent is extended or adjusted under 35 U.S.C. 154(b) by 0 days.

This patent is subject to a terminal disclaimer.

(21) Appl. No.: 12/406,572

(22) Filed: Mar. 18, 2009

(65) Prior Publication Data

US 2010/0069204 A1 Mar. 18, 2010

Related U.S. Application Data

(63) Continuation of application No. 10/496,178, filed as application No. PCT/NZ02/00255 on Nov. 20, 2002, now abandoned.

(30) Foreign Application Priority Data

Nov. 20, 2001 (NZ) ..... 513331

(51) Int. Cl.
*A63B 5/11* (2006.01)

(52) U.S. Cl. ..... 482/27

(58) Field of Classification Search ..... 482/27–29, 482/23

See application file for complete search history.

(56) References Cited

U.S. PATENT DOCUMENTS

| | | | | |
|---|---|---|---|---|
| 4,139,192 | A * | 2/1979 | McNeil | 482/27 |
| 4,836,530 | A * | 6/1989 | Stanley, Jr. | 482/27 |
| 5,941,798 | A * | 8/1999 | Coan et al. | 482/27 |
| 6,022,303 | A * | 2/2000 | Abdo | 482/140 |
| 6,095,950 | A * | 8/2000 | Katz | 482/35 |
| 6,258,011 | B1 * | 7/2001 | Wolfe | 482/23 |
| 6,264,583 | B1 * | 7/2001 | Rich | 482/27 |
| 6,319,174 | B1 * | 11/2001 | Alexander | 482/27 |
| 7,678,024 | B2 * | 3/2010 | Alexander | 482/27 |

* cited by examiner

*Primary Examiner* — Fenn Mathew
(74) *Attorney, Agent, or Firm* — Dann, Dorfman, Herrell and Skillman, P.C.

(57) ABSTRACT

A soft edged trampoline includes a flexible mat supported from a base frame by a plurality of resiliently flexible rods. Each rod has an enlarged upper end. A plurality of fittings coupled to the mat about the periphery of the mat each include a socket cavity which receives the enlarged upper end of a flexible rod, so that the upper ends of the flexible rods are pivotally connected to the periphery of the mat.

23 Claims, 6 Drawing Sheets

FIGURE 6
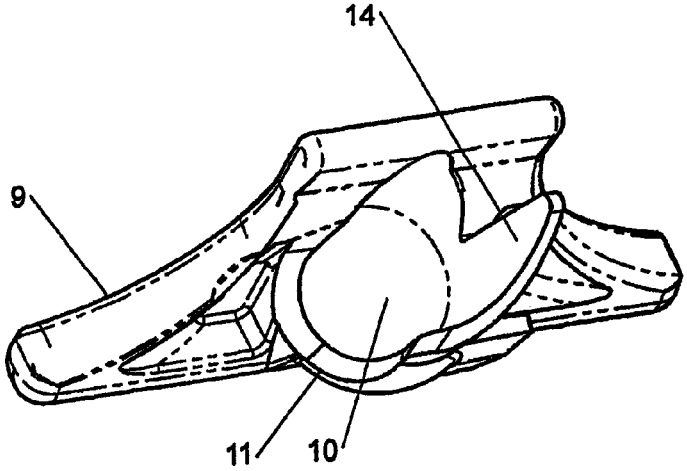
FIGURE 7
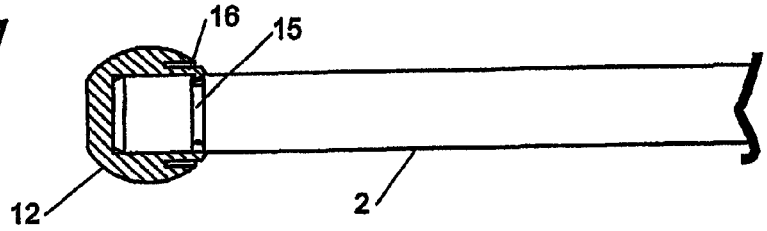
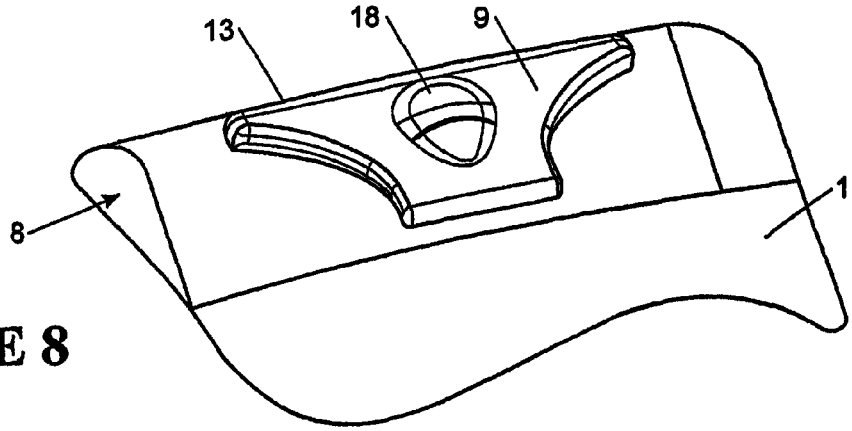
FIGURE 8

EDGE FITTINGS FOR SOFT-EDGED TRAMPOLINES

CROSS REFERENCE TO RELATED APPLICATION

This application is a continuation of U.S. application Ser. No. 10/496,178, filed Dec. 1, 2004, abandoned, which is the U.S. national stage of PCT/NZ02/00255, filed Nov. 20, 2002, the entirety of which is incorporated herein by reference.

FIELD OF INVENTION

The invention relates to a trampoline for sporting and/or recreational use which is soft-edged relative to conventional trampolines which support the mat of the trampoline via a solid peripheral frame and exposed springs between the frame and the mat.

BACKGROUND

U.S. Pat. No. 6,319,174 discloses a form of soft-edged trampoline in which the mat of the trampoline is supported by a plurality of resiliently flexible rods received in a frame of the trampoline at the lower ends of the rods and coupled to the periphery of the bouncing mat of the trampoline at their upper ends, and which avoids the need for a solid frame about the exterior of the bouncing mat and exposed springs between the frame and periphery of the mat.

SUMMARY OF THE INVENTION

The invention provides an improved or at least alternative form of such a soft-edged trampoline.

In broad terms in one aspect the invention comprises a trampoline including a flexible mat, a plurality of resiliently flexible rods each having a lower end retained in a frame of the trampoline and an enlarged upper end, and a plurality of fittings having a greater dimension approximately in the plane of the mat than in a direction through the mat, coupled to the mat about a periphery of the mat and including on or in an underside of each fitting a socket cavity which receives the enlarged upper end of a flexible rod, so that the upper ends of the flexible rods are pivotally connected to the periphery of the mat.

Preferably the fittings have an outer edge adjacent an outer edge of the mat, which outer edge of the fittings is wider approximately in the plane of the mat than an inner edge of the fittings. Typically the widest dimension of the fittings approximately in the plane of the mat is at an outer edge of the fittings closest to an outer edge of the mat. In one form the fittings have an approximate truncated triangular shape in plan view.

Preferably the fittings are positioned within a pocket or pockets in or adjacent to the peripheral edge of the mat. A part of the mat defining the pocket or pockets wraps around the outer edge of the fittings.

In broad terms in another aspect the invention comprises a trampoline including a flexible mat, a plurality of resiliently flexible rods each having a lower end retained in a frame of the trampoline and an enlarged upper end, and a plurality of fittings coupled to the mat about a periphery of the mat and including on or in an underside of each fitting a socket cavity which receives the enlarged upper end of a flexible rod so that the upper ends of the flexible rods are pivotally connected to the periphery of the mat, and wherein the fittings have a wide outer edge adjacent an outer edge of the mat which engages a pocket or pockets about or in the periphery of the mat.

In broad terms in a further aspect the invention comprises a trampoline including a flexible mat, a plurality of fittings coupled to the mat about a periphery of the mat, a plurality of resiliently flexible rods each having a lower end retained in a frame of the trampoline and an upper end connected to a said fitting, and or in an underside of each fitting a socket cavity which receives an enlarged upper end of the flexible rod connected to the fitting or a ball shaped portion which is received by a socket cavity on the end of the rod connected to the fitting, so that the upper ends of the flexible rods are pivotally connected to the periphery of the mat.

In the trampoline of the invention the coupling of the upper ends of the rods to the periphery of the mat via fittings having a cavity on the underside of the fittings and enlarged upper ends of the rods (or vice versa) provides a number of advantages. The end of the rod is enclosed so that it is much less likely to cause harm to a user falling on the edge of the trampoline. A more secure coupling between the ends of the rods and the mat, so that the rods remain more securely attached while the trampoline is in use, is achieved. And the connection allows easy assembly and disassembly of the rod-spring from the mat edge. Trampolines are generally freighted to the purchaser in dis-assembled form and it is essential that the purchaser can assemble the trampoline from the separate components without difficulty.

In this specification (including claims) the term "trampoline" is intended to extend to smaller trampolines commonly referred to as rebounders also, as well as larger trampolines of all sizes.

BRIEF DESCRIPTION OF ME DRAWINGS

Preferred forms of trampoline are described with reference to the accompanying drawings by way of example and without intending to be limiting, wherein.

Figure 3:
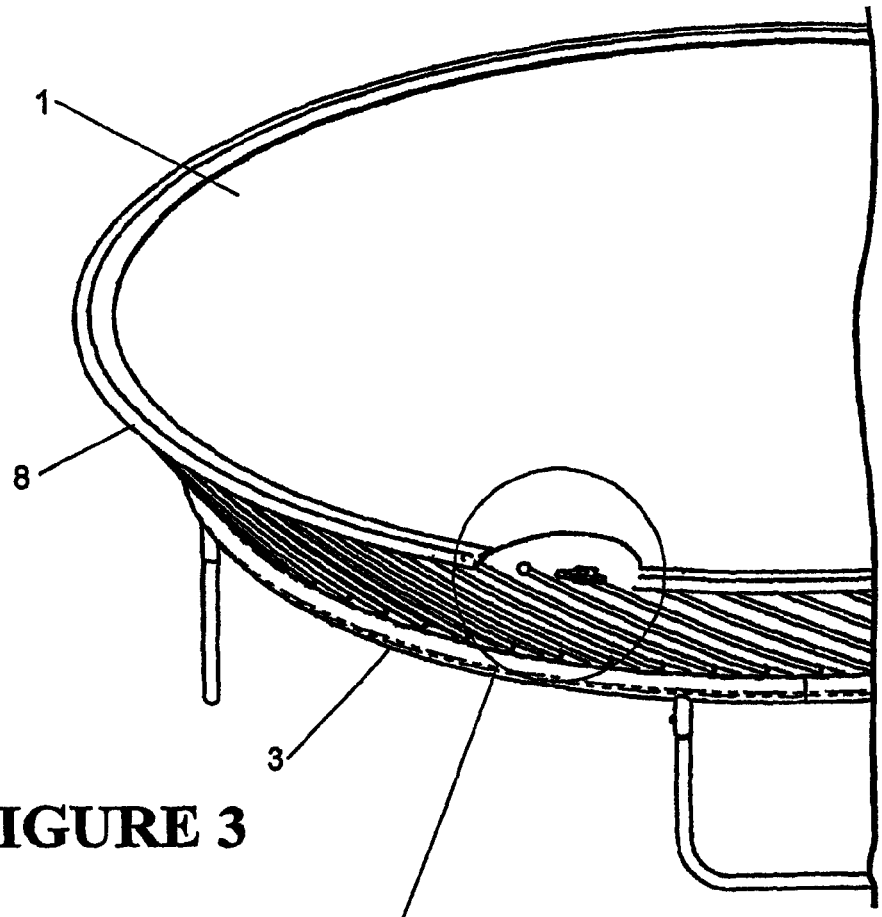
Figure 3A:
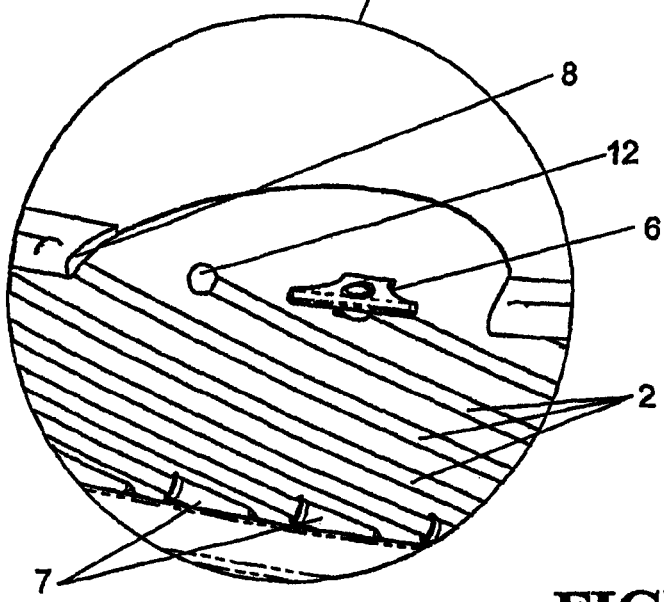
Figure 4:
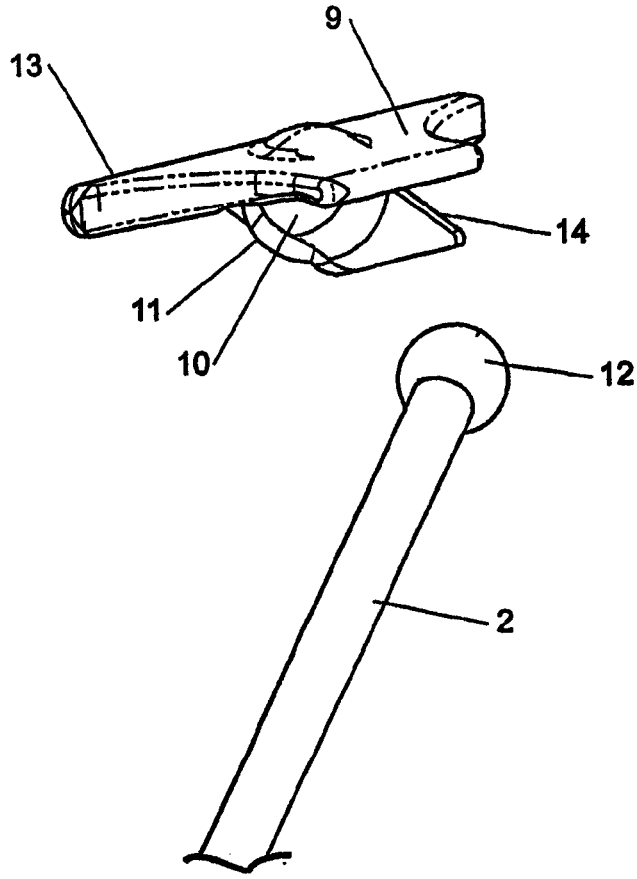
Figure 5:
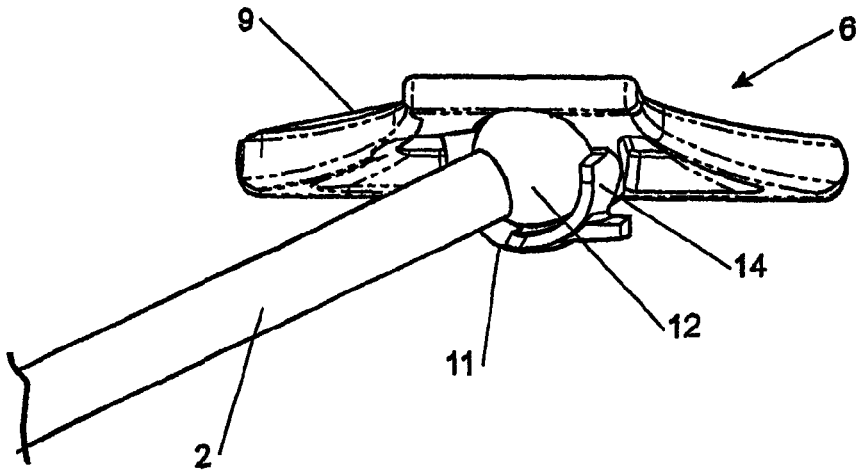
Figure 9:
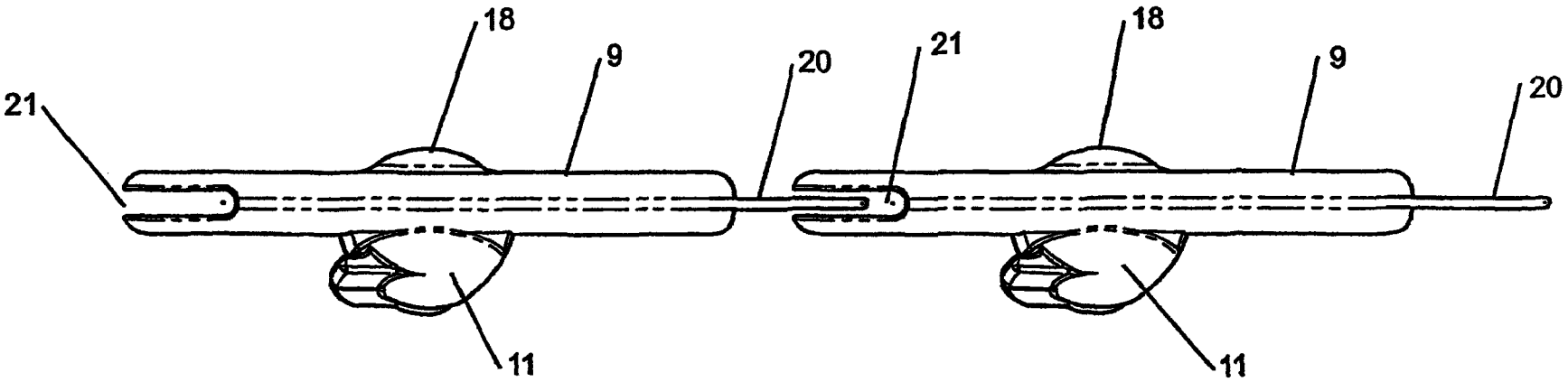

FIG. 3 is similar to FIG. 1 but of one side of the trampoline only and showing a portion of the edge of the mat of the trampoline cut away, and FIG. 3*a* is an enlarged view of the cut away edge portion of the trampoline, FIG. 4 shows an individual fitting and rod end separate from the other components of the trampoline, FIG. 5 shows the fitting and rod end connected together, from below, FIG. 6 shows the fitting alone from below, FIG. 7 is an enlarged part cross-sectional view of the end part of a rod and a rod end, FIG. 8 shows a portion of the periphery of the mat of the trampoline, showing a single fitting in position within a pocket in the periphery of the mat, and FIG. 9 shows an alternative arrangement where the fittings around the periphery of the trampoline are coupled together by a flexible tongue and recess connection between adjacent fittings.

DETAILED DESCRIPTION OF PREFERRED FORMS

Figure 1:
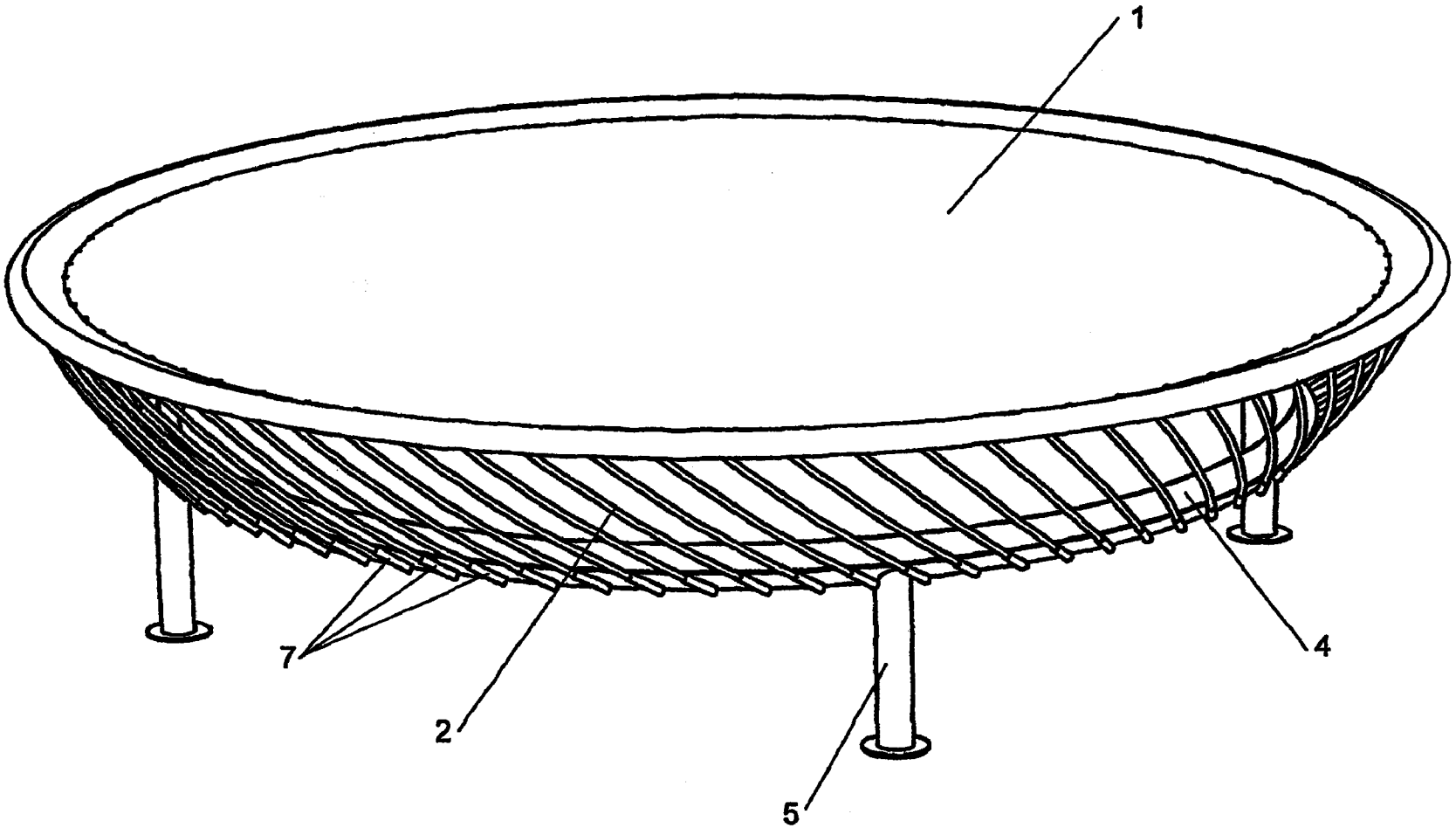
FIG. 1 is a perspective view of a preferred form trampoline.
Figure 2:
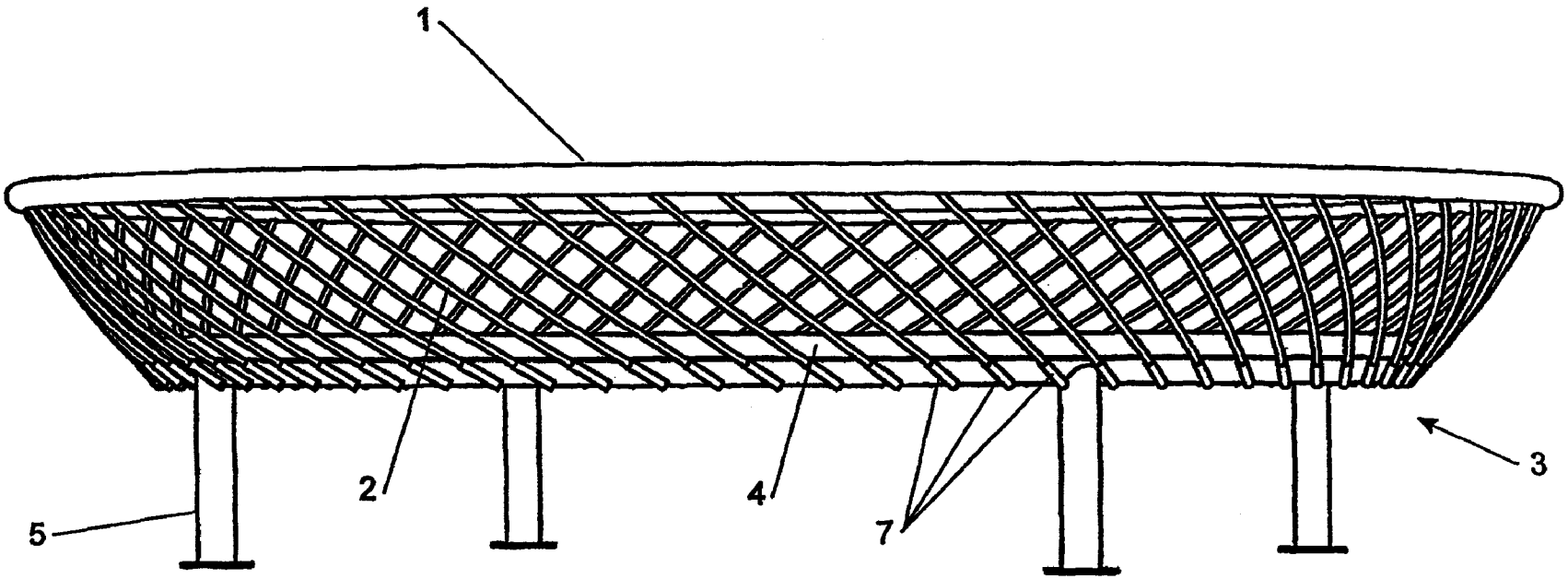
FIG. 2 is a side view of the trampoline of FIG. 1.

Referring to FIGS. 1 to 3, the preferred form trampoline comprises a flexible mat 1 on which users may bounce, a plurality of resiliently flexible rods 2, and a base frame 3. The preferred form trampoline shown is circular in shape but the trampoline could be of any other desired shape such as oval, square, rectangular or similar.

The base frame of the preferred form trampoline comprises a circular beam 4 typically formed of steel or aluminium for example, which may be supported from the ground by legs 5.

The rods 2 are typically fibre glass rods but may alternatively be formed of spring steel for example. The lower ends of the rods are retained by the base frame 3 and the upper ends of the rods connect to fittings 6 as will be further described, which are coupled to the mat 1 about the periphery of the mat. In the preferred form the lower ends of the rods 2 enter into tubular holders 7 fixed to the circular beam as shown, but the lower ends of the rods may be coupled to the circular beam, or a base frame of the trampoline of any other form, in any suitable way.

In the preferred form the mat, which is typically heavy canvas or a woven synthetic material, is doubled back upon itself and fixed by stitching for example about the periphery of the mat to form a continuous pocket 8 extending about the periphery of the mat. A number of the fittings 6 are positioned within this pocket in the peripheral edge of the mat as shown in FIG. 3 in particular and also FIG. 8. The fittings may be loosely captured within the pocket or alternatively may be stitched to the mat within the edge pocket, or mechanically fastened to the mat via rivets for example.

The rods have enlarged upper ends which connect to the fittings 6. FIGS. 4 to 8 show a fitting and the connection of a rod end to the fitting in more detail. Preferably the fittings have a generally planar body portion 9, and a socket cavity 10 is defined on or in an underside of the body portion 9 of the fitting. The body 9 of the fitting of the fitting has a greater dimension approximately in the plane of the mat than in a direction through the mat. Typically the fittings will be formed from a plastics material, by injection moulding for example. In the preferred form portion 11 extends downwardly from the underside of the fitting to define the socket cavity 10. The enlarged rod end fits 12 into the socket cavity 10, as shown into FIG. 6 in particular. The fitting may optionally include a slight dome 18 on body of the fitting over the socket cavity 10.

Also in the preferred form the fittings have an outer edge 13 which in use is closest to the outer peripheral edge of the mat, which edge 13 is wider in the plane of the mat than an inner edge of the fittings. The particular fitting 6 shown has an approximate truncated triangular shape in plan view, with concave sides, but this is non-limiting and in other forms the fitting could be alternatively shaped.

In the preferred form the part of the mat which is doubled back to define the pocket 8 in the peripheral edge of the mat wraps around the outer edges 13 of the fittings 6, as shown in FIGS. 3 and 3A so that in use the outer edges of the fittings contact the inside surface of the pocket at its outer edge as shown, which assists in transferring forces between the fitting and the mat or vice versa. This may not be essential however, and in an alternative form individual pockets may be formed adjacent but spaced from the outer most peripheral edge of the mat, and defined by stitching through the mat to form the pockets which each receive and retain a fitting. Alternatively again the fittings may instead of being received in a pocket or pockets in the outer edge of the mat, be stitched directly to the mat adjacent its outer edge, or mechanically fastened to the mat.

In use as the trampoline is bounced on by a user, this will cause pivotal movement between the upper ends 12 of the rods 2 and the fittings 6 coupled to the mat, to a greater or lesser extent depending upon the size and energy of the user. If the user bounces close to a part of the edge of the mat, significant movement of the ball ends 12 of the few rods closest to the point where the user bounces will pivot significantly within the socket cavities 10 in the fittings. A relatively secure and safe coupling of the upper ends of the rods to the mat is provided, without adversely affecting the performance of the trampoline is use. In addition the ends of the flexible rods are enclosed to increase protection to a user falling on the edge of the trampoline. At the same time assembly and disassembly of the trampoline and in particular connection between the individual rods and the mat can be carried out with relative ease. Typically the trampoline will be delivered to a purchaser in disassembled form. The purchaser need only insert the lower ends of the rods into the trampoline base, loosely place the mat over the trampoline base, and then bend each resilient rod as required to engage the ball ends 12 of the rod into the socket cavities of the fittings 6. The rod ends can enter the fittings from the side.

In the preferred form the portion 10 of the fitting on the underside of the body 9 of the fitting which defines the socket cavity includes a part 14 which extends inwardly towards the centre of the trampoline to ensure the fitting slides over the rod below in the event of a heavy bounce on the adjacent trampoline edge. This inward extension prevents the fitting from catching on the rod below and forcing the lower rod loose from its fitting.

FIG. 8 shows a preferred connection between a fibreglass rod 2 and a separately formed ball shaped upper end part 12, which is typically injection moulded from a plastics material. An annular groove 15 is formed around the rod end as shown. A cavity is formed in the ball end part 12 which enables the end part 12 to be fitted to the rod end. The ball end part 12 includes an annular protrusion 16, which when the ball part is fitted to the rod end will snap fit into the annular groove 15. Alternatively the plastic ball part 12 may snap fit over an annular protrusion or protrusions around the rod end. Any suitable mechanical arrangement may be employed. Alternatively separately formed ball parts 12 may be bonded to the rod ends. The plastic ball parts 12 may optionally have a flattened end surface 19 which assists in stabilising the ball parts if they are placed upside down on a surface during insertion of the rods 2 during assembly of a trampoline.

FIG. 9 shows an alternative form where the fittings 6 are coupled together. The fittings 6 are generally similar to those described previously but each include an integrally moulded flexible plastic tongue 20 on one side and corresponding recess on the other side, so that the flexible tongue 20 of one fitting engages into the recess 21 in the adjacent fitting in the assembled trampoline. The depth of the recess 21 is sufficient to allow movement of the tongue into and from the recess as a user bounces on the trampoline and during use the tongue 20 will flex, particularly when a user bounces near the edge of the trampoline. In a yet further alternative form, the adjacent fittings 6 may slidingly overlap with one another.

In the preferred forms described above a ball shaped end part on the rods 2 is received in a socket cavity of the fittings 6. In an alternative form the upper end of each rod may provide a socket cavity in which is received a ball shaped portion moulded on the underside of the fittings 6. The socket cavity on the upper end of the rod may be defined by an injection moulded plastic part fitted to the end of the rod.

The foregoing describes the invention including preferred forms thereof. Alterations and modifications as will be obvious to those skilled in the art are intended to be incorporated within the scope hereof as defined in the accompanying claims.

What is claimed is:

1. A trampoline including a flexible mat a plurality of resiliently flexible rods each having a lower end retained in a frame of the trampoline and an enlarged upper end, and a plurality of fittings having a greater dimension approximately in the plane of the mat than in a direction through the mat, coupled to the mat about a periphery of the mat and including on or in an underside of each fitting a socket cavity which receives the enlarged upper end of a flexible rod, so that the upper end of the flexible rod is pivotally connected to the fitting.

2. A trampoline according to claim 1 wherein the fittings have an outer edge adjacent an outer edge of the mat, which outer edge of the fittings is wider approximately in the plane of the mat than an inner edge of the fittings.

3. A trampoline according to claim 1 wherein the widest dimension of the fittings approximately in the plane of the mat is at an outer edge of the fittings closest to an outer edge of the mat.

4. A trampoline according to claim 2 wherein the widest dimension of the fittings approximately in the plane of the mat is at an outer edge of the fittings closest to an outer edge of the mat.

5. A trampoline according to claim 1 wherein the fittings have an approximate truncated triangular shape in plan view.

6. A trampoline according to claim 1 wherein the fittings are positioned within a pocket or pockets in or adjacent the peripheral edge of the mat.

7. A trampoline according to claim 6 wherein a part of the mat defining the pocket or pockets wraps around the outer edge of the fittings.

8. A trampoline according to claim 1 wherein the fittings are stitched to the mat or otherwise mechanically fastened to the mat.

9. A trampoline according to claim 1 wherein a part of the each fitting which defines the socket cavity in or on the underside of the fitting, which receives the enlarged upper end of a flexible rod, depends downwardly from the underside of the fitting.

10. A trampoline according to claim 9 wherein the part of the fitting which depends downwardly from the underside of the fitting to define the socket cavity includes a portion which extends towards the centre of the trampoline and shaped to further assist in preventing the enlarged end of a rod from dislodging from the fitting during use of the trampoline.

11. A trampoline according to claim 9 wherein the fittings are one piece fittings formed from a plastics material.

12. A trampoline according to claim 1 wherein the fittings slidingly overlap with adjacent fittings or are slidingly or flexibly coupled to adjacent fittings.

13. A trampoline according to claim 1 wherein the enlarged upper ends of the rods are approximately ball shaped.

14. A trampoline according to claim 13 wherein the enlarged upper ends of the rods are separately formed from the rods and are fitted to the upper ends of the rods.

15. A trampoline according to claim 14 wherein the rods include an annular groove around the rod ends spaced from the ends of the rods and the separately formed enlarged upper end parts include one or more protrusions arranged to snap fit into the annular grooves about the ends of the rods to fix the enlarged end parts to the rods.

16. A trampoline according to claim 14 wherein the rods include an annular protrusion or protrusions spaced annularly around the rods adjacent the ends of the rods and the separately formed enlarged upper end parts snap fit over said protrusion or protrusions to fix the end parts to the rods.

17. A trampoline according to claim 15 wherein the end parts have a flattened end surface.

18. A trampoline according to claim 12 wherein adjacent fittings are coupled by an extending tongue portion of one fitting engaging into a recess in an adjacent fitting.

19. A trampoline including a flexible mat a plurality of resiliently flexible rods each having a lower end retained in a frame of the trampoline and an enlarged upper end, and a plurality of fittings coupled to the mat about a periphery of the mat and including on or in an underside of each fitting a socket cavity which receives the enlarged upper end of a flexible rod so that the upper ends of the flexible rods are pivotally connected to the fittings, and wherein the fittings have a wide outer edge adjacent an outer edge of the mat which engages a pocket or pockets about or in the periphery of the mat.

20. A trampoline including a flexible mat, a plurality of fittings coupled to the mat about a periphery of the mat, a plurality of resiliently flexible rods each having a lower end retained in a frame of the trampoline and an upper end connected to one of said fittings, and or in an underside of each fitting a socket cavity which receives an enlarged upper end of the flexible rod connected to the fitting or a ball shaped portion which is received by a socket cavity on the end of the rod connected to the fitting, so that the upper ends of the flexible rods are pivotally connected to the fittings.

21. A trampoline according to claim 20 wherein the widest dimension of the fittings is approximately in the plane of the mat and at an outer edge of the fittings closest to an outer peripheral edge to the mat.

22. A trampoline according to claim 20 wherein the fittings are positioned within a pocket or pockets in the peripheral edge of the mat.

23. A trampoline according to claim 22 wherein the fittings are positioned within a pocket or pockets in the peripheral edge of the mat.

* * * * *